US006910288B2

(12) United States Patent
Dua

(10) Patent No.: US 6,910,288 B2
(45) Date of Patent: Jun. 28, 2005

(54) FOOTWEAR INCORPORATING A TEXTILE WITH FUSIBLE FILAMENTS AND FIBERS

(75) Inventor: Bhupesh Dua, Portland, OR (US)

(73) Assignee: Nike, Inc., Beaverton, OR (US)

( * ) Notice: Subject to any disclaimer, the term of this patent is extended or adjusted under 35 U.S.C. 154(b) by 26 days.

(21) Appl. No.: 10/323,609

(22) Filed: Dec. 18, 2002

(65) Prior Publication Data

US 2004/0118018 A1 Jun. 24, 2004

(51) Int. Cl.[7] ..... A43B 23/00

(52) U.S. Cl. ..... 36/45; 36/47; 36/48; 12/146 C; 12/146 D

(58) Field of Search ..... 36/45, 88, 47, 36/48, 49; 12/142 R, 146 C, 146 CK, 186 D

(56) References Cited

U.S. PATENT DOCUMENTS

| | | | | |
|---|---|---|---|---|
| 2,147,197 A | | 11/1936 | Glidden | |
| 3,583,081 A | | 6/1971 | Hayashi | |
| 4,211,806 A | | 7/1980 | Civardi et al. | |
| 4,255,949 A | | 3/1981 | Thorneburg | |
| 4,373,361 A | | 2/1983 | Thorneburg | |
| 4,447,967 A | | 5/1984 | Zaino | |
| 4,607,439 A | | 8/1986 | Harada | |
| 4,750,339 A | * | 6/1988 | Simpson et al. | 66/172 R |
| 4,785,558 A | | 11/1988 | Shiomura | |
| 4,813,158 A | | 3/1989 | Brown | |
| 6,230,524 B1 | * | 5/2001 | Kolmes et al. | 66/172 R |
| 6,588,237 B2 | * | 7/2003 | Cole et al. | 66/202 |
| 2002/0148258 A1 | * | 10/2002 | Cole et al. | 66/202 |

FOREIGN PATENT DOCUMENTS

| | | | |
|---|---|---|---|
| FR | 2171172 | | 9/1973 |
| GB | 1219433 | | 1/1971 |
| GB | 1427711 | * | 3/1976 |
| WO | WO 9003744 | | 4/1990 |

OTHER PUBLICATIONS

Internet publication entitled "2002: Manufacturing Program," from Luxilon Industries N.V., which was on sale in this country at least one year prior to the filing date of the present application, 3 pps.

Internet publication entitled "Grilon Multifit," from EMS--Griltech, which was on sale in this country at least one year prior to the filing date of the present application, 5 pps.

* cited by examiner

*Primary Examiner*—M. D. Patterson
(74) *Attorney, Agent, or Firm*—Banner & Witcoff, Ltd.

(57) ABSTRACT

The invention is an upper for an article of footwear that includes a textile having fusible filaments or fibers. The textile is incorporated into the upper and specific areas of the upper are heated such that the fusible filaments or fibers fuse with other filaments or fibers to form fused areas. In comparison with unfused areas of the upper, the fused areas may impart properties that include greater stretch-resistance, stability, support, abrasion-resistance, durability, and stiffness, for example. In addition, the fused areas generally provide air-permeability without significantly increasing the weight of the footwear.

24 Claims, 8 Drawing Sheets

FOOTWEAR INCORPORATING A TEXTILE WITH FUSIBLE FILAMENTS AND FIBERS

BACKGROUND OF THE INVENTION

1. Field of the Invention

The present invention relates to footwear. The invention concerns, more particularly, footwear wherein a textile incorporated into the footwear includes filaments and fibers formed of a fusible material.

2. Description of Background Art

Conventional articles of footwear generally include an upper and a sole structure attached to the upper. The materials selected for the upper vary significantly between different styles of footwear, but generally include a textile material. Athletic footwear, for example, often includes an upper having textiles that are stitched or adhesively bonded to a thermoset foam layer. Similarly, hiking boots and work boots often include a durable outer shell formed of leather and an inner lining formed of a textile joined with foam materials.

A textile may be defined as any manufacture from fibers, filaments, or yarns characterized by flexibility, fineness, and a high ratio of length to thickness. Textiles generally fall into two categories. The first category includes textiles produced directly from webs of filaments or fibers by randomly interlocking to construct non-woven fabrics and felts. The second category includes textiles formed through a mechanical manipulation of yarn, thereby producing a woven fabric, for example.

Yarn is the raw material utilized to form textiles in the second category. In general, yarn is defined as an assembly having a substantial length and relatively small cross-section that is formed of at least one filament or a plurality of fibers. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modem filaments include a plurality of synthetic materials such as rayon, nylon, polyester, and polyacrylic, with silk being the primary, naturally-occurring exception. Yam may be formed of a single filament, which is conventionally referred to as a monofilament yarn, or a plurality of individual filaments grouped together. Yam may also include separate filaments formed of different materials, or the yarn may include filaments that are each formed of two or more different materials. Similar concepts also apply to yarns formed from fibers. Accordingly, yarns may have a variety of configurations that generally conform to the definition provided above.

The various techniques for mechanically manipulating yarn into a textile include interweaving, intertwining and twisting, and interlooping. Interweaving is the intersection of two yarns that cross and interweave at right angles to each other. The yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being the most common method of interlooping.

The textiles utilized in footwear uppers generally provide a lightweight, air-permeable structure that is flexible and comfortably receives the foot. In order to impart other properties to the footwear, including durability and stretch-resistance, additional materials are commonly combined with the textile, including leather, synthetic leather, or rubber, for example. With regard to durability, U.S. Pat. No. 4,447,967 to Zaino discloses an upper formed of a textile material that has a polymer material injected into specific zones to reinforce the zones against abrasion or other forms of wear. Regarding stretch resistance, U.S. Pat. Nos. 4,813,158 to Brown and 4,756,098 to Boggia both disclose a substantially inextensible material that is secured to the upper, thereby limiting the degree of stretch in specific portions of the upper.

From the perspective of manufacturing, utilizing multiple materials to impart different properties to an article of footwear is an inefficient practice. For example, the various materials utilized in a conventional upper are not generally obtained from a single supplier. Accordingly, a manufacturing facility must coordinate the receipt of specific quantities of materials with multiple suppliers that may have distinct business practices or may be located in different countries. The various materials may also require additional machinery or assembly line techniques to cut or otherwise prepare the material. In addition, incorporating separate materials into an upper may involve a plurality of distinct manufacturing steps requiring multiple individuals.

Employing multiple materials, in addition to textiles, may also detract from the breathability of footwear. Leather, synthetic leather, or rubber, for example, are not generally permeable to air. Accordingly, positioning leather, synthetic leather, or rubber on the exterior of the upper may inhibit air flow through the upper, thereby increasing the amount of perspiration, water vapor, and heat trapped within the upper and around the foot.

SUMMARY OF THE INVENTION

The present invention is an article of footwear having a sole structure and an upper secured to the sole structure. The upper includes a textile that is at least partially formed from a plurality of first strands and a plurality of second strands, which may be filaments, fibers, or yarns that incorporate filaments or fibers, for example. The first strands are formed of a thermoplastic polymer material, and the textile includes a fused area wherein the first strands are fused to the second strands. The fused area may have increased stretch-resistance, stability, support, abrasion-resistance, durability, and stiffness, for example, when compared to areas of the textile that are unfused.

The textile may be a non-woven material that includes the strands, or the textile may be formed from a mechanically manipulated yarn that includes the strands. Accordingly, a wide range of textiles are suitable for forming the upper. The strands may also be formed to have various configurations. For example, the first strands may be monocomponent strands that only include the thermoplastic polymer material. The first strands may also be bicomponent strands that include two or more thermoplastic polymer materials, perhaps in a core-sheath relationship. With regard to bicomponent strands, the two or more thermoplastic polymer materials may be selected to have different melting temperatures, for example.

The invention also embraces a method of manufacturing the upper that includes the steps of providing a plurality of strands, at least a first portion of the strands including at least one thermoplastic polymer material; incorporating the strands into a textile that forms a portion of the upper; and forming a fused area of the textile by fusing at least the first portion of the strands to a second portion of the strands. This method may be applied to uppers that are formed to have the general structure of a conventional upper that incorporates fusible strands, or may be applied to knit uppers that incorporate fusible strands.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

The following discussion and accompanying figures disclose articles of footwear formed of a textile that includes fusible filaments or fibers. For purposes of the present discussion, filaments and fibers may be referred to individually or collectively as strands. In general, the fusible strands may be fused to other strands, whether fusible or non-fusible, in selected areas of the footwear to increase stretch-resistance, stability, support, abrasion-resistance, durability, and stiffness, for example. Advantageously, these benefits may be achieved without significantly inhibiting the air-permeability of the textile or increasing the weight of the footwear.

Figure 1:
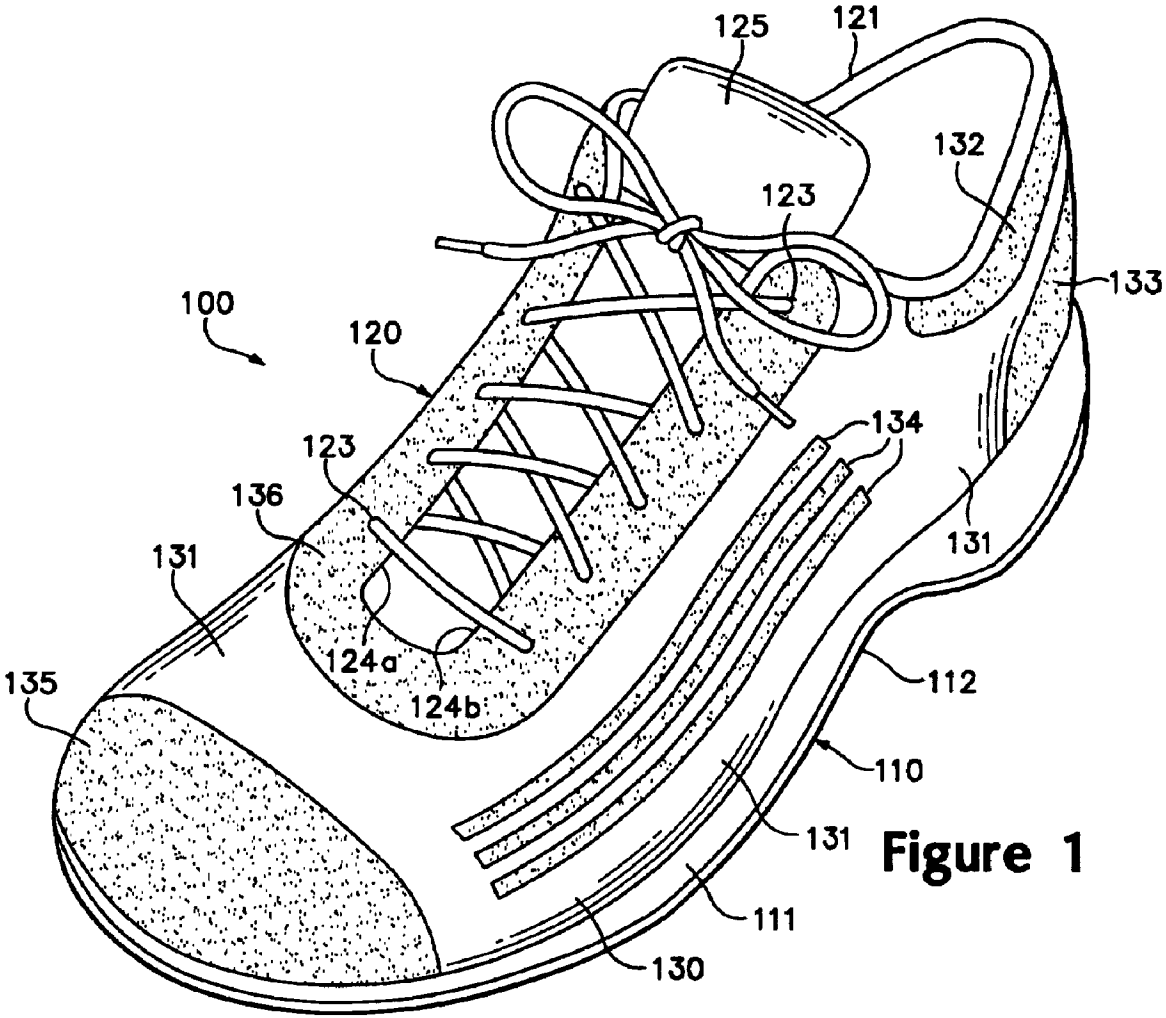
FIG. 1 is a perspective view of an article of footwear incorporating a textile with fusible strands in accordance with the present invention.

An article of footwear 100 is disclosed in FIG. 1 and includes a textile with fusible strands. Footwear 100 is depicted as an article of athletic footwear, particularly a running shoe. The concepts disclosed with respect to footwear 100 may, however, be applied to a variety of footwear styles, including other types of athletic footwear, dress shoes, boots, and sandals, for example. The present invention, therefore, is not limited to a specific type of footwear that incorporates the textile of the present invention, but applies generally to a wide range of footwear styles.

The primary elements of footwear 100, as depicted in FIG. 1, are a sole structure 110 and an upper 120. Sole structure 110 generally extends between the foot and the ground, whereas upper 120 is configured to receive the foot and comfortably secure the position of the foot relative to sole structure 110.

Sole structure 110 has a conventional configuration that includes an insole (not depicted), a midsole 111, and an outsole 112. The insole is a relatively thin, cushioning member located within upper 120 and adjacent to the foot for enhancing the comfort of footwear 100. Midsole 111 is attached to a lower portion of upper 120 and is formed of a cushioning foam material, such as ethylvinylacetate or polyurethane. Accordingly, midsole 111 attenuates ground reaction forces and absorbs energy associated with running or walking. To enhance the force attenuation and energy absorption characteristics of sole structure 110, midsole 111 may incorporate a fluid-filled bladder, as disclosed in U.S. Pat. Nos. 4,183,156 and 4,219,945 to Rudy. Alternately, midsole 111 may incorporate a plurality of columnar support elements, as disclosed in U.S. Pat. Nos. 5,353,523 and 5,343,639 to Kilgore et al. Outsole 112, which may be formed from carbon black rubber compound, is attached to a lower surface of midsole 111 to provide a durable, wear-resistant surface for engaging the ground. In addition, outsole 112 may incorporate a textured lower surface to enhance the traction characteristics of footwear 100.

Sole structure 110 is described above as having the elements of a conventional sole structure for a running shoe. Other types of athletic footwear, including basketball shoes, tennis shoes, soccer shoes, and cross-training shoes, for example, will generally have a sole structure with a similar configuration. Dress shoes, boots, and sandals, however, may have other types of conventional sole structures specifically tailored for use with the respective types of footwear. Accordingly, the particular configuration of sole structure 110 may vary significantly within the scope of the present invention to include a wide range of configurations.

Upper 120 forms a void within footwear 100 for receiving the foot. Access to the void is provided by an ankle opening 121, located primarily in a heel region of footwear 100. The volume of the void within upper 120 may be adjusted by a lacing system extending across the top of upper 120 and through a midfoot region and a forefoot region of footwear 100 (i.e., the lacing system extends along the instep area of footwear 100). The lacing system includes a lace 122 that is threaded through a plurality of apertures 123 and across a space formed between a medial edge 124*a* and lateral edge 124*b* formed in upper 120. In general, lace 122 may be utilized to modify the size of the space between medial and lateral edges 124, as is well known in the art, thereby adjusting the volume of the void within upper 120. A tongue 125 is positioned below medial edge 124*a* and lateral edge 124*b* to enhance the comfort of the area around the lacing system.

A textile 130 is positioned on an exterior of upper 120, and additional materials such as foam and other textiles may be positioned within upper 120. The general structure of upper 120 is similar, therefore, to the structure of a conventional upper for an article of athletic footwear. In contrast with the conventional upper, however, textile 120 includes unfused areas 131 and fused areas 132–136. In general, textile 130 is manufactured from yarn that is produced from a plurality of strands. At least a portion of the strands are formed from a thermoplastic material, and the application of heat to specific areas of textile 130, which later become fused areas 132–136, causes the thermoplastic strands to melt. Following the melting of individual thermoplastic strands, molten material either surrounds unmolten strands or intermingles with molten material from other thermoplastic strands. The temperature is then reduced and the molten material solidifies, thereby forming fused areas 132–136.

Based upon the above discussion, textile 130 may generally have a plurality of unfused areas 131 and a plurality of fused areas 132–136. Unfused areas 131 have an appearance of conventional textiles, and the properties of unfused areas 131 may be similar to the properties of conventional textiles. In comparison with unfused areas 131, fused areas 132–136 generally have greater stiffness and stretch-resistance, enhanced abrasion-resistance, and increased durability. In addition, fused areas 132–136 may provide support and stability to specific areas of footwear 100. Accordingly, a footwear manufacturer may select specific portions of upper 120 that would benefit from the inherent textile qualities of unfused areas 131 and the fused qualities of the plurality of fused areas 132–136.

In determining the areas of an upper that should remain unfused, or become fused, one skilled in the art may determine the qualities that the material forming a specific portion of the upper should possess. In some areas of an upper, the stretch of an unfused textile would provide greater benefits than the abrasion-resistance of a fused textile. In other portions, however, the durability of a fused textile would provide greater benefits than the flexibility of an unfused textile. Accordingly, each area of an upper may be examined to determine whether fusing would enhance the quality, performance, or comfort, for example, of the footwear.

Fused areas 132–136 of footwear 100 will now be examined to demonstrate one suitable configuration of fused and unfused areas. Depending upon the intended use for the footwear and the desired aesthetics of the footwear, other articles of footwear may include fused and unfused areas that are located in other portions of an upper. With respect to footwear 100, however, fused area 132 circumscribes ankle opening 121 and provides stretch-resistance in the area of ankle opening 121. As the individual walks or runs, the ankle presses against ankle opening 121, thereby tending to stretch the portion of footwear 100 that forms ankle opening 121. Fused area 141 is located, therefore, to prevent significant enlargement of ankle opening 121.

Fused area 133 extends around the heel portion of upper 120 and effectively surrounds a heel of the wearer. Fused area 133 is similar to a heel counter that is often utilized in athletic footwear to limit movement of the heel, thereby providing stability and support in the heel area of footwear 100. Textile 130 may be fused in the heel area, therefore, to provide the benefits of a heel counter without the necessity of incorporating additional components into footwear 100.

Fused area 134 is generally elongate strips that extend horizontally or longitudinally along the lateral side of upper 120. Fused area 134 limits horizontal stretch on the lateral side of footwear 100, therefore, but permits lateral stretch of unfused areas 131 in the vertical direction. A similar fused area may be located on the medial side of footwear 100 to limit vertical stretch on the medial side. As the individual walks or runs, the foot may press against upper 120, thereby tending to stretch upper 120 longitudinally. Accordingly, fused area 134 is located to prevent the stretch, thereby limiting movement of the foot relative to footwear 100. As an alternative, fused area 134 may cover a greater area of the lateral side, or may extend vertically or diagonally, for example.

Fused area 135 is positioned in a toe region of upper 120 and provides a high degree of abrasion-resistance and durability to the toe region. In general, the toe regions of footwear often contact abrasive surfaces, such as rocks, concrete, or trees, that may wear away or otherwise degrade the strength of the upper. By fusing the various strands in fused area 135, however, the abrasion-resistance and durability of this portion of upper 120 may be enhanced.

Fused area 136 extends along medial edge 124*a* and lateral edge 124*b* and provides two primary benefits to the lacing system. As discussed above, the lacing system includes lace 122 that is threaded through apertures 123 and across a space formed between medial edge 124*a* and lateral edge 124*b*. In general, lace 122 may be utilized to modify the size of the space between medial edge 124*a* and lateral edge 124*b*, thereby adjusting the volume of the void within upper 120. In adjusting laces 122, the individual generally pulls on ends of laces 122, thereby inducing tension in laces 122 and drawing medial edge 124*a* and lateral edge 124*b* toward each other. Fused area 136 increases the stiffness of medial edge 124*a* and lateral edge 124*b*, thereby ensuring that medial edge 124*a* and lateral edge 124*b* are uniformly drawn toward each other. A further benefit of fused area 136 relates to the construction of apertures 123. In conventional articles of footwear, the lacing apertures include grommets to limit unraveling of the textile that forms the aperture. In footwear 100, however, the grommets are not necessary to prevent unraveling due to the fused nature of textile 130.

Fused areas 132–136 are intended to provide examples of the manner in which portions of textile 130 may be fused in order to impart differing characteristics to footwear 100. As discussed, fused areas 132–136 have the potential to provide greater stiffness, stretch-resistance, abrasion-resistance, and durability, and fused areas 132–136 may provide enhanced support and stability. Accordingly, one skilled in the relevant art may select specific areas of a textile to fuse in order to impart various properties to the areas, regardless of the type of footwear or the intended use of the footwear.

The stretch-resistance imparted by fused areas 132 and 134, the stability and support provided by fused area 133, the abrasion-resistance and durability of fused area 135, and the stiffness of fused area 136 may be imparted to upper 120 through an alternate procedure, namely the provision of additional elements. For example, leather elements may be secured around ankle opening 121 to increase stretch-resistance, a polymer heel counter may be incorporated into the heel area to provide stability, and rubber elements may be adhered to the surface of upper 120 in the toe region to provide abrasion-resistance. Although the additional elements may impart the required properties to upper 120, the additional elements would also increase the expense of manufacturing upper 120 and add weight to upper 120. In contrast, fused areas 132–136 beneficially-utilize the preexisting textile 130 to impart the desired properties without utilizing additional elements or increasing the weight of footwear 100. Furthermore, the additional elements are generally formed of materials that are not air-permeable, thereby limiting the overall air-permeability of the footwear. Fused areas 132–136 retain a substantial portion of the air-permeability of unfused areas 131.

Textile 130 may be formed through a variety of conventional textile manufacturing techniques, including randomly interlocking strands to construct a non-woven fabric. Textile 130 may also be formed by mechanically manipulating yarn through interweaving, intertwining and twisting, or interlooping. In either scenario, textile 130 includes a plurality of fusible strands formed of a thermoplastic polymer material, such as polyurethane, nylon, polyester, and polyolefin. In addition, the fusible strands may be any of the strands that are incorporated into the thermo-fusible yarns produced by Luxilon Industries N.V. of Wijnegum, Belgium under the THERMOLUX trademark. Such strands are available in a variety of melting temperatures, including 60, 90, 105, 108, 130, and 150 degrees Celsius. Other suitable fusible strands are available from EMS-Griltech, a division of EMS-Chemie AG of Ems, Switzerland, and marketed under the trademarks of GRILON, which is a polyamide and copolyamide bicomponent fiber, GRILAMID, which is a polyamide fiber, and GRILENE, which is a copolyester fiber.

Figure 2A:
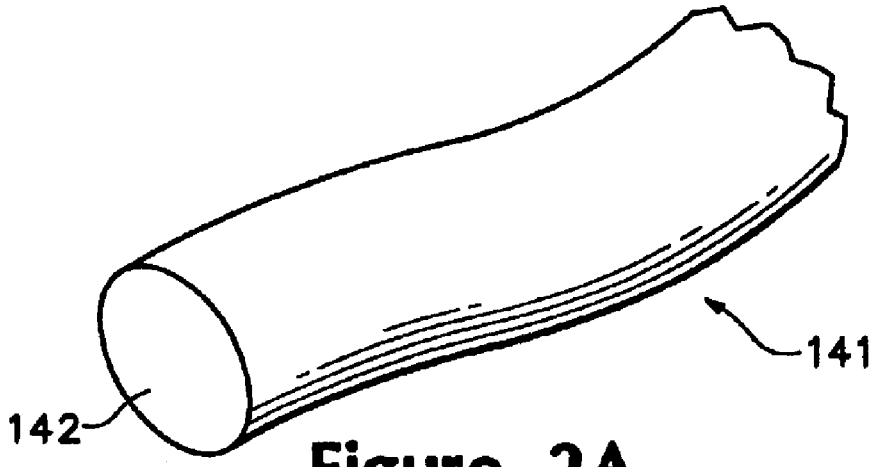
FIG. 2A is a perspective view of a monocomponent strand.
Figure 2B:
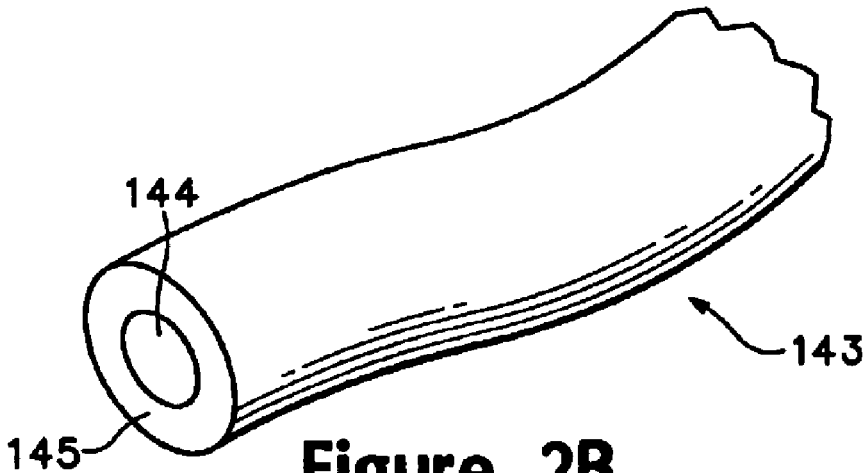
FIG. 2B is a perspective view of a bicomponent strand.

The fusible strands may have a variety of configurations within the scope of the present invention. FIG. 2A depicts a monocomponent strand 141 formed of a single thermoplastic polymer material 142. The act of raising the temperature of strand 141 above a melting temperature of material 142 causes strand 141 to become molten and permits strand 141 to fuse with other strands. In contrast, FIG. 2B depicts a bicomponent strand 143 formed of two thermoplastic polymer materials 144 and 145 arranged in a core-sheath relationship. That is, material 144 forms a central portion of strand 143 and material 145 surrounds the central portion. Materials 144 and 145 may be selected to such that material 144 has a higher melting temperature than material 145. Raising the temperature of strand 143 to a point above the melting temperature of material 145, but below the melting temperature of material 144, will cause melting in only material 145. This may be desirable, for example, when only a relatively small degree of fusing between the various strands is required. Further raising the temperature of strand 143 above the melting temperature of material 144 will cause melting in both materials 144 and 145. This may be desirable when a greater degree of fusing is required. Accordingly, strands having various combinations of thermoplastic polymer materials may be utilized within the scope of the present invention.

Monocomponent strand 141 is formed of a single material 142 with substantially similar properties throughout. In contrast, bicomponent strand 143 is formed of two thermoplastic polymer materials 144 and 145 arranged in a core-sheath relationship. Materials 144 and 145 may both be polyester, for example, with different melting temperatures. Alternately, material 144 may be nylon and material 145 may be polyurethane, for example. Accordingly, bicomponent strand 143 is formed to have materials with different properties. In addition to the core-sheath relationship in bicomponent strand 143, materials 144 and 145 may be arranged in a side-by-side configuration, or any other configuration wherein different distinct areas of strand 143 includes materials 144 and 145.

Figure 3A:
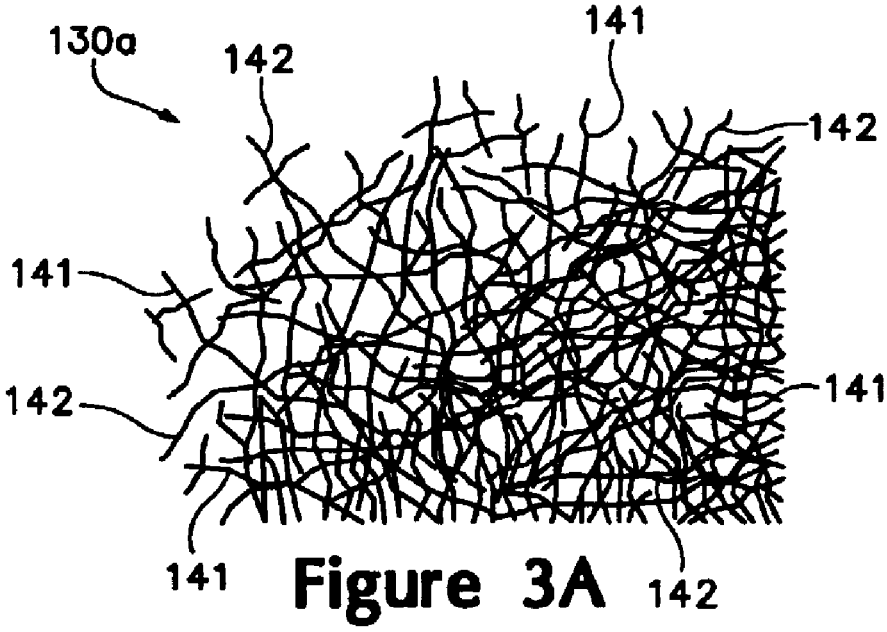
FIG. 3A is a plan view of a portion of the textile, which is formed to have a non-woven structure.

As discussed above, textile 130 may be formed through a variety of conventional textile manufacturing techniques. With reference to FIG. 3A, a non-woven textile 130*a* formed of randomly interlocked monocomponent strands 141 and bicomponent strands 143 are depicted. By selecting material 142 of strands 141 to have a melting temperature that is different than both materials 144 and 145 of strands 143 provides further variation in the manner in which temperatures affect the degree of fusing that occurs. In further embodiments, however, textile 130*a* may be formed of only monocomponent strands, or only bicomponent strands, for example. Similarly, a non-woven textile may be formed of monocomponent strands, bicomponent strands, or a combination of monocomponent and bicomponent strands.

Figure 3B:
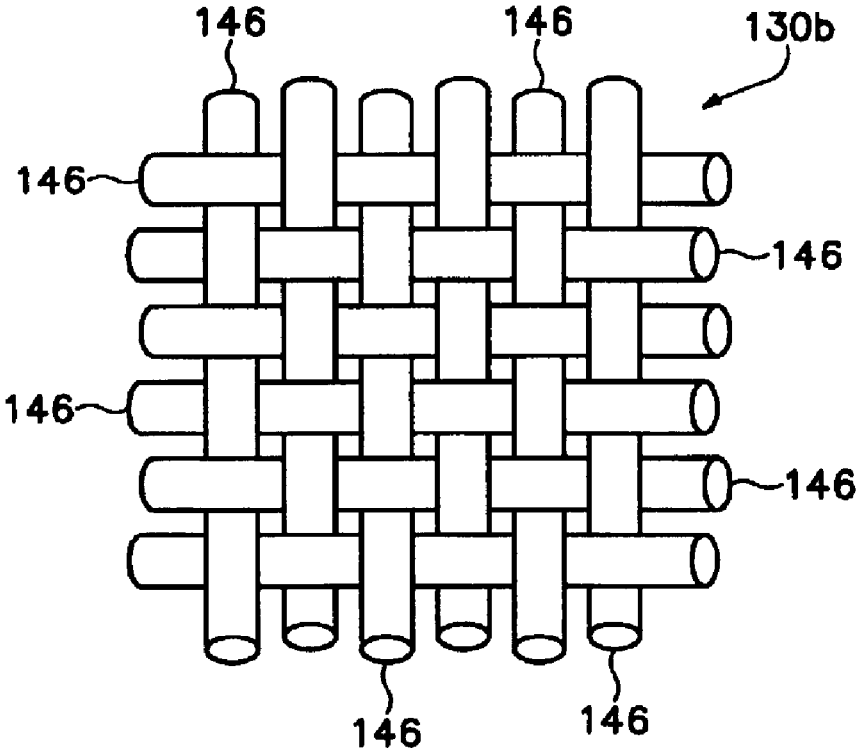
FIG. 3B is a plan view of a portion of the textile, which is formed through an interweaving process.
Figure 3C:
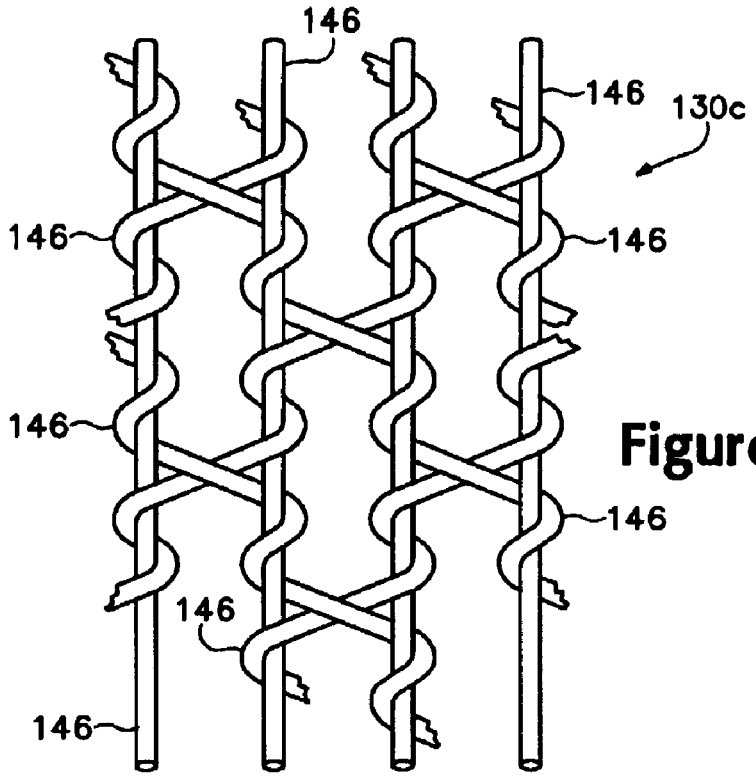
FIG. 3C is a plan view of a portion of the textile, which is formed through an intertwining and twisting process.
Figure 3D:
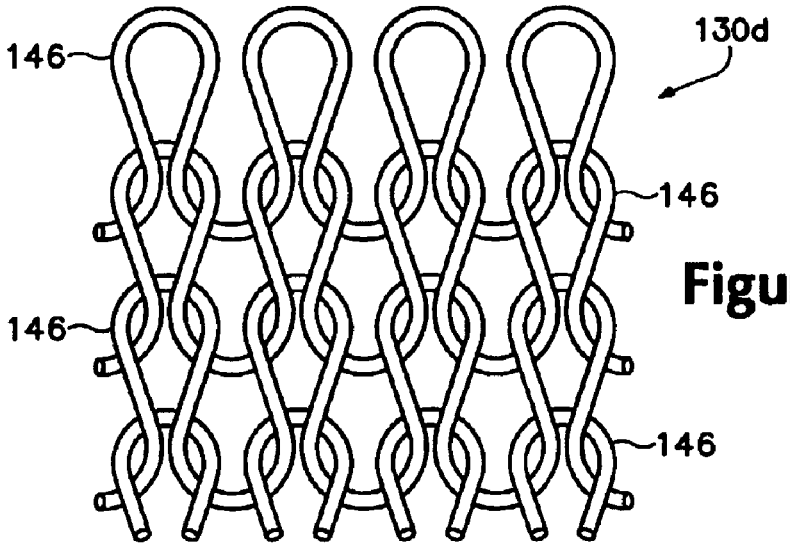
FIG. 3D is a plan view of a portion of the textile, which is formed through an interlooping process.

A variety of textiles 130*b*–130*d* that are formed by mechanically manipulating a yarn 146 are depicted in FIGS. 3B–3D. In contrast with textile 130*a*, which is formed of randomly interlocked strands, the various strands of textiles 130*b*–130*d* are organized into yarn 146. Textile 130*b* is depicted in FIG. 3B and is formed through the interweaving manufacturing process. Textile 130*c* is depicted in FIG. 3C and is formed through the intertwining and twisting manufacturing process. Similarly, textile 130*d* is depicted in FIG. 3D and is formed through the interlooping manufacturing process. The various configurations of textiles 130*b*–130*d* are intended to provide an example of the many techniques that may be utilized to mechanically manipulate yarn 146 into a textile. Other techniques for mechanically manipulate yarn 146 into a textile, or variations upon the general techniques discussed above, are also intended to fall within the scope of the invention.

Figure 4A:
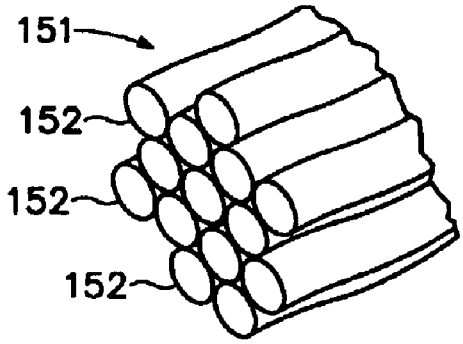
FIG. 4A is a perspective view of a yarn formed of monocomponent strands.
Figure 4B:
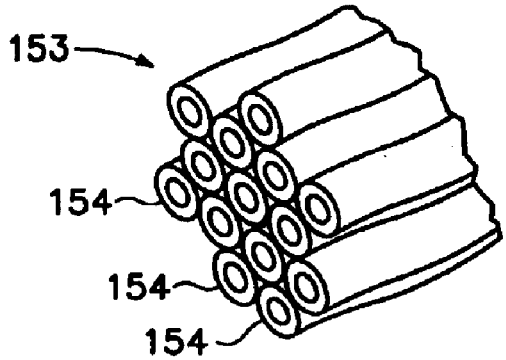
FIG. 4B is a perspective view of a yarn formed of bicomponent strands.
Figure 4C:
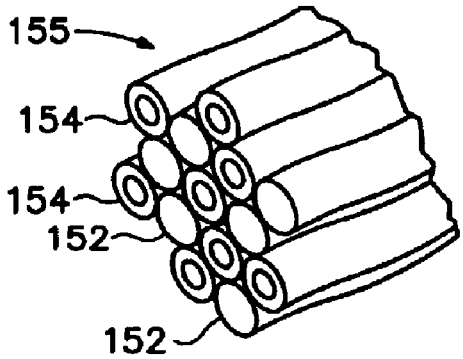
FIG. 4C is a perspective view of a yarn formed of monocomponent strands and bicomponent strands.
Figure 4D:
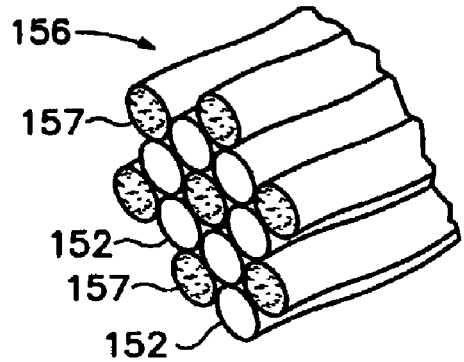
FIG. 4D is a perspective view of a yarn formed of monocomponent strands and neutral strands.

The yarn that is suitable for use in textiles 130*b*–130*d* may have a variety of configurations within the scope of the present invention. As discussed below, various yarns 151, 153, 155, and 156 are formed of various strands 152, 154, and 157. FIG. 4A depicts a yarn 151 that is formed of only monocomponent strands 152, and FIG. 4B depicts a yarn 153 formed of bicomponent strands 154. If a greater range of fusibility is desired, textiles 130*b*–130*d* may incorporate a yarn 155 having both monocomponent strands 152 and bicomponent strands 154, as depicted in FIG. 4C. In some circumstances, however, a yarn may be utilized that incorporates strands that are not fusible, hereafter referred to as neutral strands. The neutral strands may be formed of non-melting materials, such as a thermoset polymer, cotton, or wool, for example. Accordingly, textiles 130*b*–130*d* may also include a yarn 146 that includes monocomponent strands 152 and neutral strands 157, as depicted in FIG. 4D. Each of yarns 151, 153, 155, and 156 are suitable for use in textiles 130*b*–130*d*. In further embodiments, textiles 130*b*–130*d* may include combinations of yarns 151, 153, 155, and 156, or a portion of the strands utilized in yarns 151, 153, 155, and 156 may be formed solely of neutral strands.

Based upon the preceding discussion, textiles 130*b*–130*d* may incorporate various types of yarn 146, which may be similar in composition to yarns 151, 153, 155, and 156, for example. In addition, a portion of the yarns 146 that form textiles 130*b*–130*d* may be formed entirely of neutral strands. Accordingly, the textile configurations falling within the scope of the present invention may include varying types and proportions of fusible strands and neutral strands.

Figure 5:
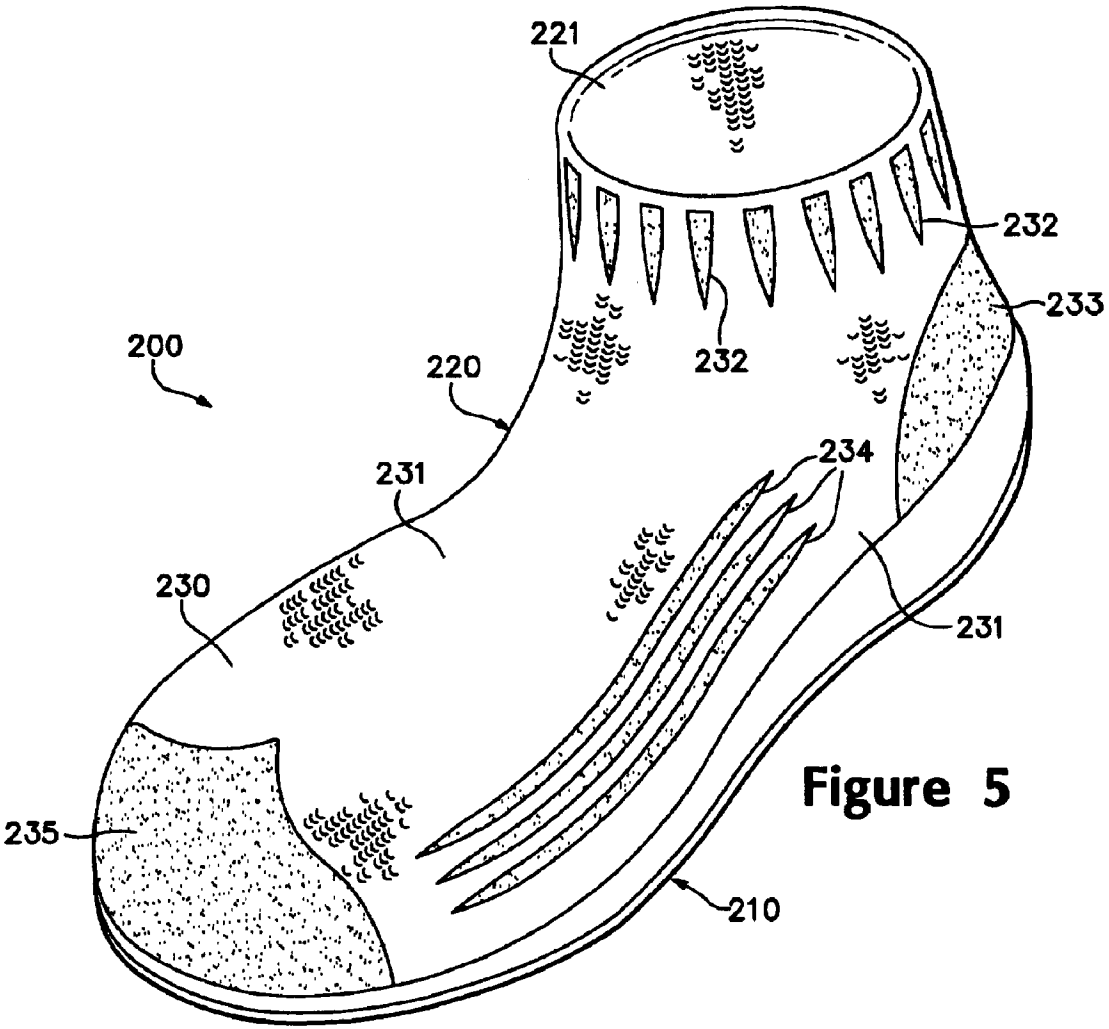
FIG. 5 is a perspective view of another article of footwear incorporating a textile with fusible strands in accordance with the present invention.

Footwear 100 is depicted as having a configuration that is similar to the configuration of conventional articles of athletic footwear. In contrast, however, footwear 100 includes a textile 130 that incorporates fusible materials, and footwear 100 includes various areas where the fusible materials are fused to impart properties that include stretch-resistance, stability, support, abrasion-resistance, durability, and stiffness, for example. An article of footwear 200 that is formed to have a non-conventional, textile upper is depicted in FIG. 5.

Footwear 200 includes a sole structure 210 and an upper 220. Sole structure 210 may be similar in configuration to upper 110 of footwear 100. Upper 220, however, is primarily a textile that is formed of mechanically manipulated yarn. A conventional circular knitting machine, for example, may be utilized to manufacture upper 220. In general, circular knitting machines form a tube-like structure from a plurality of yarns. Upper 220, therefore, also has a tube-like structure with openings at opposite ends of the tube. An ankle opening 221 forms a first opening for extending around the ankle and providing access to the interior of upper 220, and an aperture (not depicted) in the lower surface of upper 220 forms a second opening. The aperture is analogous to the seam that extends over the toes in a conventional sock that is also manufactured on a circular knitting machine.

Upper 220 is formed of a textile 230, which has a knitted structure that is similar to textile 130*d*, as disclosed in FIG. 3D above. Accordingly, textile 230 includes yarns with fusible strands. Following the manufacture of upper 220 on a circular knitting machine, for example, specific areas of upper 220 may be fused to modify the properties of upper 220. Upper 220 will include, therefore, a plurality of unfused areas 231 and a plurality of fused areas 232–235. Various procedures for forming fused areas 232–235 will be discussed in greater detail below.

Textile 230 may be formed to include yarns with fusible strands that extend throughout textile 230 or only through the portions of textile 230 that are fused to form fused areas 232–235. When the yarns with fusible strands extend throughout textile 230, only select areas are heated to form fused areas 232–235. When the yarns with fusible strands are located only in the portions of textile 230 that are fused to form fused areas 232–235, however, then the entirety of textile 230 may be heated to form fused areas 232–235.

Fused areas 232 extend vertically around ankle opening 221 and may be utilized to limit vertical stretch in the area of ankle opening 221, while permitting horizontal stretch. The amount of stretch in ankle opening 221 may be modified by increasing or decreasing the degree of fusing that occurs between the various strands. Fused area 233 is located around the heel portion of upper 220 and may be utilized to stabilizes the heel. Fused areas 234 extend horizontally along the longitudinal length of the medial and lateral sides of upper 220 to limit longitudinal stretch, while permitting stretch in the girth of upper 220. Finally, fused area 235 may be located in the toe region of upper 220 to increase the abrasion-resistance and durability of footwear 100.

The preceding discussion disclosed articles of footwear 100 and 200, which are formed of textiles that include fusible strands. In order to increase stretch-resistance, stability, support, abrasion-resistance, durability, and stiffness, for example, the fusible strands may be bonded to other strands in selected areas of footwear 100 and 200. Advantageously, these benefits may be achieved without significantly inhibiting the air-permeability of the textile or increasing the weight of the footwear.

Footwear 100 and footwear 200 may be manufactured through a variety of procedures. With regard to footwear 100 specifically, textile 130 may be manufactured on any of a variety of conventional textile manufacturing machines. Fusible strands may be incorporated into textile 130 by replacing one or more of the conventional neutral strands that characterize many conventional textiles. Following the manufacture of textile 130 in bulk form, three general procedures for forming fused areas 132–136 may be utilized. In the first procedure, fused areas 132–136 are formed with a hot die, steam, hot air, or radio frequency heating, for example, in specific portions of a relatively large section of textile 130. Individual elements of textile 130 may then be cut from the relatively large section and incorporated into upper 120. In the second procedure, the individual elements of textile 130 are cut and fused areas 132–136 are formed prior to incorporating the individual elements into upper 120. In the third procedure, the individual elements of textile 130 are cut and incorporated into upper 120, and fused areas 132–136 are subsequently formed. With regard to the third procedure, a last may be inserted into upper 120 to provide support and fused areas 132–136 may be formed with a hot die, for example, that contacts the exterior of upper 120. Accordingly, the manner in which individual strands are melted to form fused areas 132–136 may vary significantly within the scope of the present invention.

With regard to footwear 200, textile 230 may be formed with a circular knitting machine to have the structure generally described above. An example of a suitable, commercially available circular knitting machine that may be utilized to form textile 230 is sold by Sangiocomo S.p.A. of Italy under the X-MACHINE trademark. The X-MACHINE has been used to produce argyle-style socks where multiple colored yarns form argyle and other complex patterns. In manufacturing textile 230, for example, the X-MACHINE may be selected to have a 4 inch cylinder with 160 needles. Through proper programming of such a circular knitting machine, textile 230 may be formed to have a variety of configurations. For example, textile 230 may have fusible strands that are located throughout upper 220. That is, the fusible strands may be distributed in a substantially uniform manner in almost all portions of upper 220. In this configuration, select areas may be heated to form fused areas 232–235. A last may be placed within upper 220 to provide support when the various areas are being fused. Alternately the circular knitting machine may be programmed to place fusible strands in only selected areas of upper 220. That is, the fusible strands may be located only in the areas of upper 220 that are intended to form fused areas 232–235. In this configuration, all of upper 220 may be heated uniformly, but only the areas having fusible strands will form fused areas 232–235. Following the manufacture of textile 230 using the circular knitting machine, textile 230 may be placed within a dying bath to impart color. The dying bath may be heated to a temperature that exceeds the melting temperature of the fusible strands. When the fusible strands are located only in select areas, the use of a heated dying bath may be an effective an efficient and effective manner of forming fused areas 232–235. Alternately, textile 230 may be immersed in hot steam or air, for example, to form fused areas 232–235.

Footwear 100 and footwear 200 are disclosed above as having discrete fused and unfused areas. More particularly, footwear 100 has unfused areas 131 and separate fused areas 132–136. Similarly, footwear 200 includes unfused areas 231 and fused areas 232–234. In both embodiments, the fused areas are in specific portions of footwear 100 and footwear 200 in order to impart specific properties to the fused areas. As discussed above, specific fused areas may be achieved through two different general methods of manufacture. According to a first method, a yarn with fusible strands may be incorporated into all of the upper and only select areas may be heated to achieve fusing of the fusible strands. According to a second method, a yarn with fusible strands may be incorporated into selected areas of the upper and the entire upper may be heated so as to achieve fusing in only the selected areas, which then become fused areas.

Figure 6A:
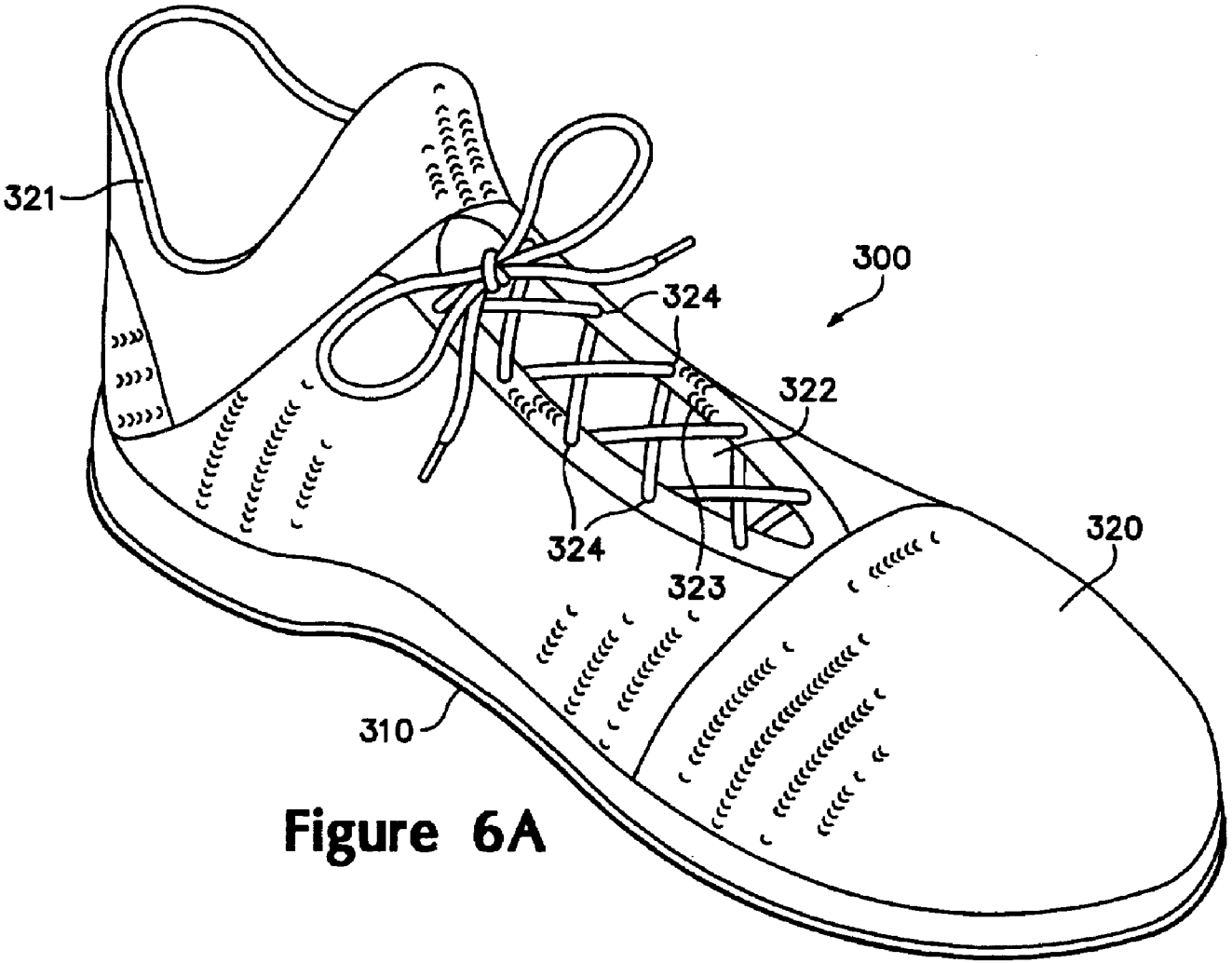
FIG. 6A is a first perspective view of yet another article of footwear incorporating a textile with fusible strands in accordance with the present invention.
Figure 6B:
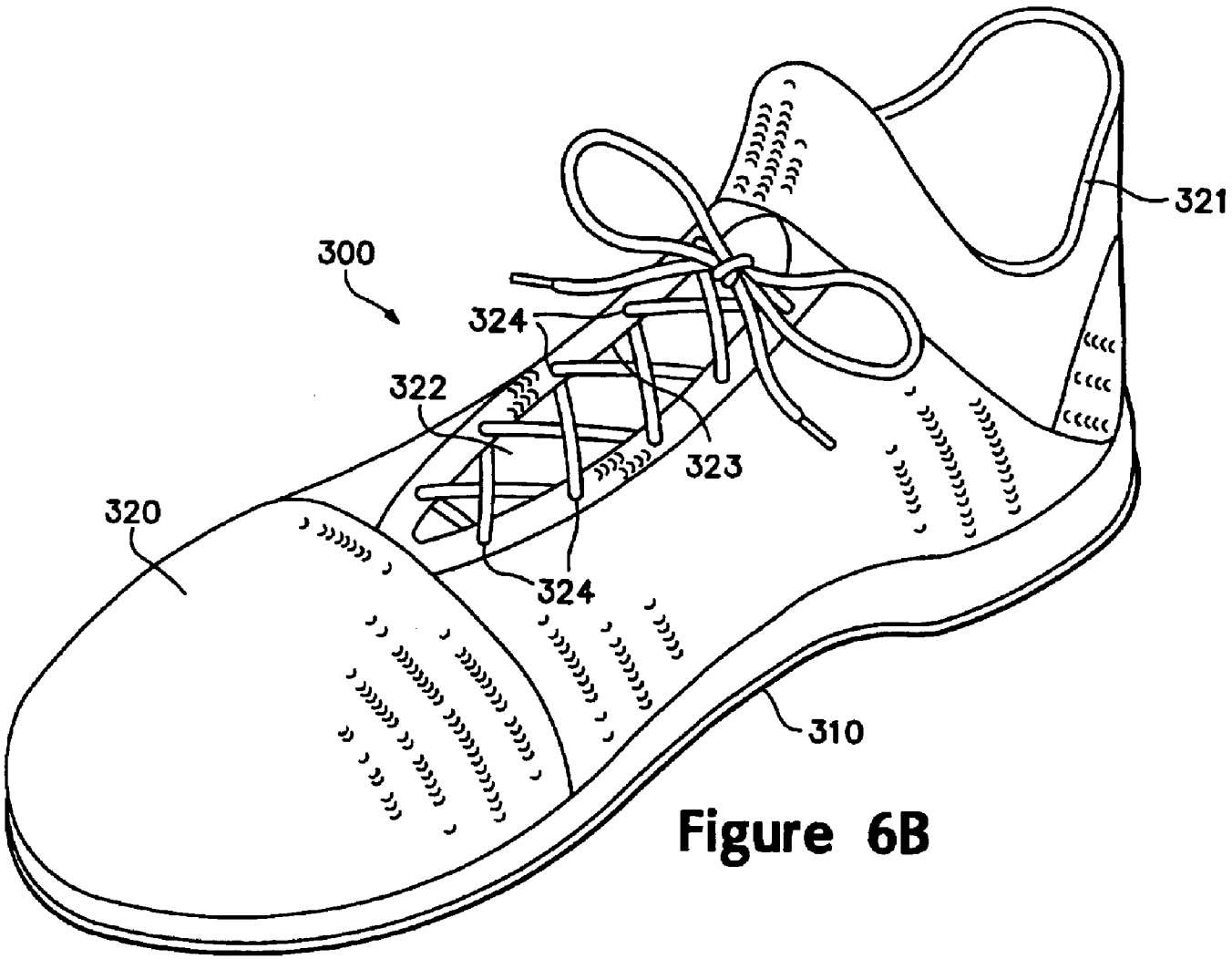
FIG. 6B is a second perspective view of the article of footwear depicted in FIG. 6A.

Another article of footwear 300 is disclosed in FIGS. 6A and 6B and is formed of a knit structure with a circular knitting machine similar to the X-MACHINE described above. Footwear 300 includes a sole structure 310 and an upper 320. An ankle opening 321 forms an opening in upper 320 that provides the foot with access to the interior of upper 320. An instep portion of upper 320 includes a tongue 322 that extends under a longitudinal opening 323. A plurality of eyelets 324 are positioned adjacent to longitudinal opening 323 to form apertures for receiving laces. Accordingly, upper 320 is a knit structure with a general configuration that is similar to a conventional upper. In contrast with conventional uppers, however, a substantial portion of upper 320 incorporates a yarn with fusible strands, as detailed below.

Substantially all of the textile that forms upper 320 includes a yarn with fusible strands. More particularly, the portions of upper 320 that are depicted as having a ribbed configuration, which is a majority of upper 320, include a yarn with fusible strands. The remaining portions, which include tongue 322 and the area surrounding ankle opening 321, are knit so as to include yarns without fusible strands. In further embodiments, however, tongue 322 and the area surrounding ankle opening 321 may incorporate a yarn with fusible strands. Although selected areas of upper 320 may be heated to form fused areas, as with footwear 100 and 200, all of upper 320 is heated such that all of the ribbed area becomes effectively fused. In configurations wherein the various areas of upper 320 are separated by adjacent courses, rather than wales, a tuck stitch may be utilized to join the areas in a seamless manner.

In addition to the configurations discussed above, the portion of upper 320 that includes the yarn with fusible strands may be more limited. For example, the toe area and the heel area, although having a ribbed structure, may be formed of a yarn that does not include fusible strands in order to limit the position of the fused area to the medial side, the lateral side, and lower portions of upper 320. In each of the embodiments related to upper 320, however, a relatively large area of upper 320 includes a yarn with fusible strands, and the entirety of the area is fused in order to impart such characteristics as increased stretch-resistance, stability, support, abrasion-resistance, durability, and stiffness.

As discussed with respect to footwear 100 and 200, the fused areas impart desirable properties to an upper, which include increased stretch-resistance, stability, support, abrasion-resistance, durability, and stiffness, for example, without significantly inhibiting the air-permeability of the textile or increasing the weight of the footwear. In contrast with footwear 100 and footwear 200, wherein specific areas of the uppers are fused, substantially all of upper 320 is fused in order to take advantage of these desirable characteristics. Accordingly, it is not necessary to fuse specific, defined areas of an upper within the scope of the present invention. Instead, substantially all of the upper may be fused to impart the enhanced properties of the fused areas to a greater portion of the upper.

A variety of techniques may be utilized to melt the fusible strands within upper 320. For example, upper 320 may be immersed in a dye bath that is at a greater temperature than the melting temperature of the fusible strands. Steam may also be utilized to uniformly heat upper 320. Depending upon the materials utilized in upper 320, microwave or other radio frequency heating techniques may also be utilized. Once upper 320 is cooled, sole structure may be secured to the lower surface with an adhesive, for example.

Whereas specific portions of the uppers associated with footwear 100 and 200 were fused, a majority of upper 320 is fused. The degree of heating that occurs during the manufacture of upper 320 determines the degree of fusing that occurs between adjacent fusible strands. In certain portions of upper 320 additional heat may be applied to induce greater fusing. For example, eyelets 324 may experience significant stresses when the laces are tied, and additional fusing around eyelets 324 may serve as reinforcement. Similarly, a greater degree of fusing around a heel portion of upper 320 may be utilized to provide greater stability in the heel portion. Accordingly, different degrees of fusing may be utilized in upper 320, or in the uppers associated with footwear 100 and 200, in order to impart varying degrees of stretch-resistance, stability, support, abrasion-resistance, durability, and stiffness.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of footwear having a sole structure and an upper secured to the sole structure, the upper incorporating a textile comprising:

a fused area having a plurality of first strands that are fused to adjacent first strands to define a fused portion of the upper; and an unfused area having a plurality of second strands that are unfused to adjacent second strands to define an unfused portion of the upper, wherein the fused area is adjacent the unfused area, and each of the fused area and the unfused area are positioned in an interior portion of the textile and have a spaced relationship with edges of the textile.

2. The article of footwear of claim 1, wherein the textile is a non-woven material.

3. The article of footwear of claim 1, wherein the textile is formed from mechanically manipulated yarns, the yarns incorporating the first strands and the second strands.

4. The article of footwear of claim 1, wherein the upper is knitted to form a tubular structure.

5. The article of footwear of claim 1, wherein the first strands are formed of a single thermoplastic polymer material.

6. The article of footwear of claim 1, wherein the first strands incorporate a first thermoplastic polymer material and a second thermoplastic material, the first thermoplastic material having a first melting temperature, and the second thermoplastic material having a second melting temperature.

7. The article of footwear of claim 6, wherein the first thermoplastic polymer material forms a central portion of the first strands, and the second thermoplastic material surrounds the central portion, the first melting temperature being selected to be higher than the second melting temperature.

8. The article of footwear of claim 7, wherein the second strands are formed of a non-melting material.

9. The article of footwear of claim 1, the first strands and the second strands are formed of identical materials.

10. An article of footwear having a sole structure and an upper secured to the sole structure, the upper incorporating a textile formed from mechanically manipulated yarns, the textile comprising:

a first area incorporating a first yarn that includes a fusible material the first yarn being fused to define a fused portion of the upper; and an second area having a second yarn that includes a non-melting material to define an unfused portion of the upper, wherein the fused area is adjacent the unfused area, and each of the fused area and the unfused area are positioned in an interior portion of the textile and have a spaced relationship with edges of the textile.

11. The article of footwear of claim 10, wherein the first yarn includes strands formed from a single thermoplastic polymer material.

12. The article of footwear of claim 10, wherein the first yarn includes strands formed from:

a first thermoplastic polymer material with a first melting temperature, and a second thermoplastic material having a second melting temperature.

13. The article of footwear of claim 12, wherein the first thermoplastic polymer material forms a central portion of the strands, the second thermoplastic material surrounds the central portion, and the first melting temperature is selected to be higher than the second melting temperature.

14. The article of footwear of claim 10, wherein the first strands and the second strands are incorporated into a yarn.

15. The article of footwear of claim 10, wherein the upper is knitted to form a tubular structure.

16. An article of footwear comprising a sole structure and an upper secured to the sole structure, the upper incorporating a textile with a yarn that extends through a fused area and an unfused area of the textile, the yarn being formed of at least one thermoplastic polymer material, the yarn being fused in the fused area, and the yarn being unfused in the unfused area, wherein each of the fused area and the unfused area are positioned in an interior portion of the textile and have a spaced relationship with edges of the textile.

17. The article of footwear of claim 16, wherein the yarn is mechanically manipulated to from the textile.

18. The article of footwear of claim 16, wherein the upper is knitted to form a tubular structure.

19. An article of footwear comprising a sole structure and an upper secured to the sole structure, the upper incorporating a textile formed from mechanically manipulated yarns with a plurality of first strands and second strands that form a tubular structure, the textile having a fused area wherein the first strands are fused to adjacent first strands to define a fused portion of the upper, and the textile, having an unfused area wherein the second strands are unfused to adjacent second strands define an unfused portion of the upper, the fused area being adjacent the unfused area, and each of the fused area and the unfused area being positioned in an interior portion of the textile and have a spaced relationship with edges of the textile.

20. The article of footwear of claim 19, wherein the first strands are formed of a single thermoplastic polymer material.

21. The article of footwear of claim 19, wherein the first strands incorporate a first thermoplastic polymer material and a second thermoplastic material, die first thermoplastic material having a first melting temperature, and the second thermoplastic material having a second melting temperature.

22. The article of footwear of claim 21, wherein the first thermoplastic polymer material forms a central portion of the first strands, and the second thermoplastic material surrounds the central portion, the first melting temperature being selected to be higher than the second melting temperature.

23. The article of footwear of claim 22, wherein the second strands are formed of a non-melting material.

24. The article of footwear of claim 19, wherein the first strands and the second strands are formed of identical materials.

* * * * *